US005228158A

United States Patent [19]

Park

[11] Patent Number: 5,228,158

[45] Date of Patent: Jul. 20, 1993

[54] PORTABLE ROLLABLE LIGHT-WEIGHT PILLOWS

[76] Inventor: Carolyn B. Park, 14296 S. 3600 W., Bluffdale, Utah

[21] Appl. No.: 908,392

[22] Filed: Jul. 6, 1992

[51] Int. Cl.[5] ..... A47G 9/00

[52] U.S. Cl. ..... 5/636; 5/466

[58] Field of Search ..... 5/636, 640, 413, 644, 5/645, 466; 297/391

[56] References Cited

U.S. PATENT DOCUMENTS

| | | | |
|---|---|---|---|
| 1,269,276 | 6/1918 | Harris | 5/636 |
| 1,730,771 | 10/1929 | Jonas | 5/472 |
| 2,870,464 | 1/1959 | Lalick | 5/420 |
| 4,754,511 | 7/1988 | Sargent | 5/449 |
| 4,763,369 | 8/1988 | Spector | 5/636 |
| 4,878,258 | 11/1989 | Casey | 5/420 |

FOREIGN PATENT DOCUMENTS

| | | | |
|---|---|---|---|
| 2221011 | 10/1974 | France | 5/636 |
| 2396496 | 1/1979 | France | 5/413 |
| 512938 | 7/1956 | Italy | 5/636 |

*Primary Examiner*—Alexander Grosz

[57] ABSTRACT

A small light-weight portable and rollable pillow filled with a compressible resilient material which has a strap attached to a solid attachment means at the side thereof which can be tied around the pillow when it is rolled up and the end of the strap can be tied together to form a handle which permits the pillow to be carried.

5 Claims, 7 Drawing Sheets

PORTABLE ROLLABLE LIGHT-WEIGHT PILLOWS

BACKGROUND OF THE INVENTION

1. Field of the Invention

This invention relates to pillows, and more particularly to light-weight pillows that can be rolled up and easily carried to the desired locations, such as recreational areas.

Specifically, the invention provides a small light-weight portable and rollable pillow filled inside with spreadable and compressible resilient material which is easily compressed and allows the pillow to be rolled up for travelling or storage and yet when the pillow is spread out the pillow resumes its regular shape, said pillow having a plurality of strap means a portion of which are firmly attached inside the pillow and the remaining ends appear outside the pillow and are adapted to being used to tie around the pillow in its rolled up condition, and said handle means outside the pillow being adapted to act as a handle to carry the pillow when in the unrolled condition.

The invention further provides a process for using the new pillows which comprises laying out the pillow, width-wise rolling up the pillow to a small roll and then using the strap means to tie up the roll. The roll can then be carried by holding to the ends of the strap means. To unroll the pillow the strap means are then untied and the pillow falls out as a regular pillow.

In special occasions when one does not want the pillow rolled, the pillow can be easily carried in that position by the strap means acting as a handle for the pillow.

Department stores and bedding supply departments commonly supply consumers with pillows of regular, queen or king sized pillows. These sizes are very inconvenient for travelling, camping or recreational use. They are particularly unsuited for use when travelling long distances in buses, etc. or for recreational use when the pillow is taken to the football stadium, etc. Such pillows are unsuited for such purposes as they are very bulky, bunglesome and heavy. These common pillows are not readily adaptable for many recreational events, such as camping, backpacking, sunbathing, picnicing, boating and traveling because of the aforementioned limitations.

2. Prior Art

Various people have tried to solve this problem by creating pillows of various and sizes but they have all been useless. Most of the suggested pillows have been inflatable, such as those disclosed in U.S. Pat. Nos. 4,277,859, 4,712,259. These pillows feel differently than the usual pillow and are further susceptible to puncture or leakage due to the application of too much pressure which would contribute to the lack of comfort for those using the pillows. U.S. Pat. No. 4,768,247 provides an arrangement wherein a pillow is placed within an outer-cover to be rolled up and then taken out of the cover for use. This presents the disadvantage of keeping the outer cover during use of the pillow and the need to compress the air out of the cover before use. U.S. Pat. No. 3,604,026 and U.S. Pat. No. 257,200 disclose a pillow joined in half as to make two side of the pillow with a joint in between. This type of pillow is of little use because the head is usually placed in the center of the pillow and this would place the head directly on the hard joint between the side pillows and give little comfort.

It is an object of the invention, therefore, to provide a practical portable pillow that can solve the above-noted difficulties. It is a further object to provide a rollable portable pillow that doe snot need to be inflated before use. It is a further object to provide a one piece pillow that can be used without being taken out of another cover. It is a further object to provide a one piece pillow that is not divided in the middle. It is a further object to provide a portable rollable light-weight pillow that can be easily carried rolled or unrolled to the place where needed. It is a further object to provide a rollable portable pillow that is small in size and similar to the regular sized pillows used for this purpose. It is a further object to provide a pillow that can be tucked away under a car seat or other small place while it is being transported. It is a further object to provide a small rolled pillow that can be used by a backpacker and which an be easily attached to his belt or other carrying means. It is a further object to provide a pillow that can be easily carried to a sporting event and used as a stadium cushion. It is a further object to provide a light weight water resistant pillow that can be taken to a pool or beach without worry of getting it wet. It is a further object to provide a new type of pillow that can be carried on a bicycle or attached to a stroller or picnic basket without causing any inconvenience and problem of carrying. It is a further object to provide a new type of portable light weight pillow that can be made in a great variety of shapes and still accomplish its stated purpose. These and other objects of the invention will be apparent from the following detailed description thereof.

SUMMARY OF THE INVENTION

It has now been discovered that these and other objects can be accomplished by the new portable rollable pillows of the present invention. I have found for the first time a practical useful pillow that can be used for travel, camping, recreational purposes, etc. without the inconvenience provided by the prior known pillows.

The new type pillows covered by the present invention comprise a small light-weight portable and rollable pillow filled inside with spreadable and compressible resilient material which is easily compressed and allows the pillow to be rolled up for travelling or storage and yet when the pillow is spread out he pillow resumes its regular shape, said pillows having a plurality of strap means a portion of which are firmly attached inside the pillow and the remaining ends appear outside the pillow and are adapted to being used to tie around the pillow in its rolled up condition, and forming handle means outside the pillow being adapted to act as a handle to carry the pillow when in the unrolled condition.

The invention further provides a process for using the new pillows which comprises laying out the pillow, length wise rolling up the pillow to a small roll and then using the strap means to tie up the rolled pillow in a roll, the roll can then be carried by holding the ends of the strap means. To unroll the pillow the strap means are then untied and the pillow falls out as a regular pillow. In special occasions when one does not want the pillow rolled, the pillow can be easily carried in that position by the strap means acting as handle for the pillow.

DESCRIPTION OF THE DRAWINGS

The various objects and features of the present invention will be more fully understood by reference to the accompanying drawings.

With reference to FIG. 1, which is a cutaway side view of the pillow noted as 10, the outside cover is shown as 11, the polyester fiber is shown as 12, the polyurethane shredded particles are shown as 13, the quilting is shown as 15, the solid attachment of the cord, acting as the handle means, is shown as 16, and the two ends of the cord are shown as 17.

With reference to FIG. 2, showing a side view of the pillow noted as 18, the strap means are shown as 17.

With reference to FIG. 3, which is a top view of the pillow 19, the handle straps are shown as 20 in an untied position.

With reference to FIG. 3A, the pillow is shown as 19 with the tied cord ends shown as 20 and the tie 20B.

With reference to FIG. 4 which illustrate the rolled up pillow, the pillow is shown as 21 with the tied strap handles as 22.

With reference to FIG. 5, which shows the use of two grommets tied to the inside of the pillow, the grommets are shown as 23 and the pillow as 24.

With reference to FIG. 6, showing the use of two grommets, the grommets are shown as 26 and the cords tied into the grommets as 27.

With reference to FIG. 7, the two grommets and cooperating cords 29 illustrate how the pillow 30 can be rolled lengthwise with the tied cords 29.

DETAILED DESCRIPTION OF THE INVENTION

Figure 1:
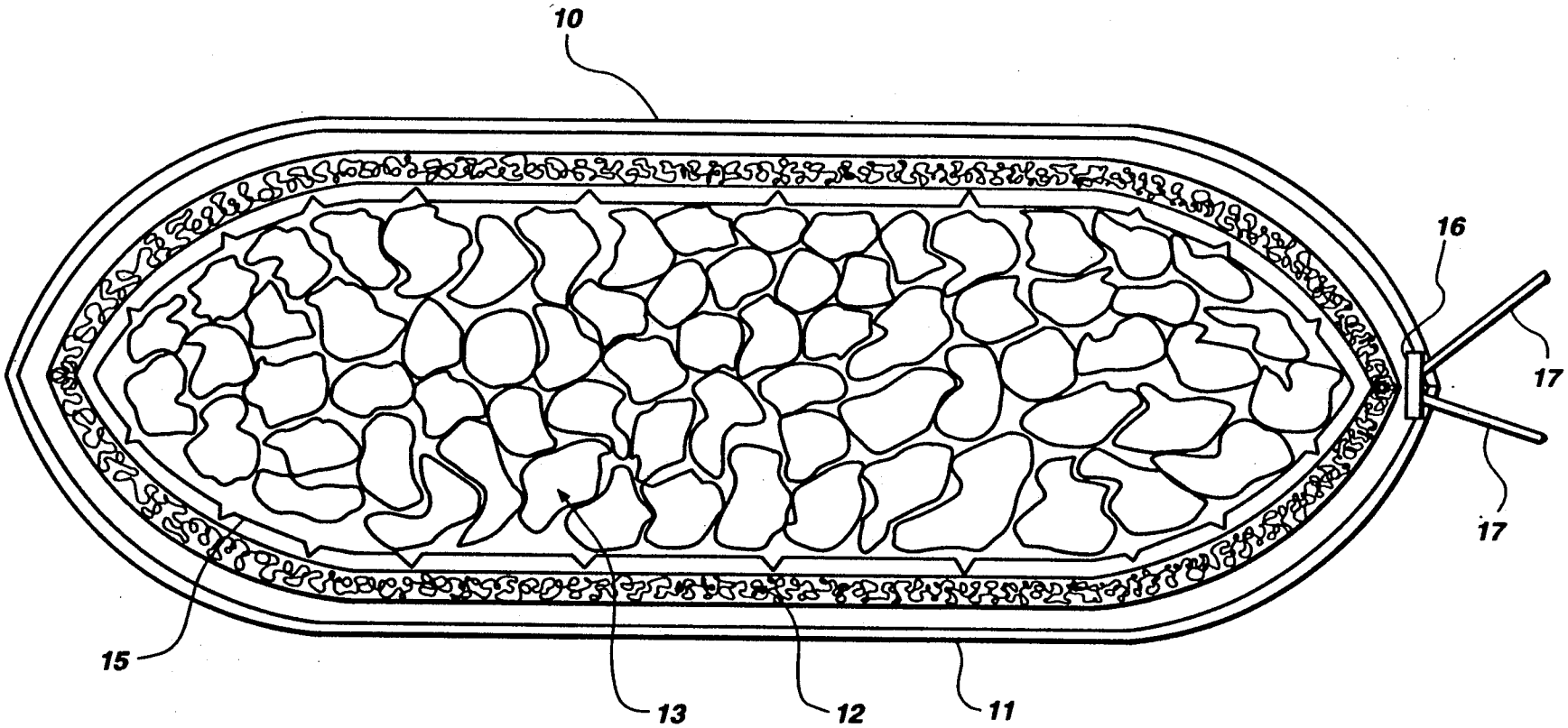
FIG. 1 is a cut away portion of the pillow showing the various components of the pillow and how the strap handle is joined to the inside of the pillow.
Figure 2:
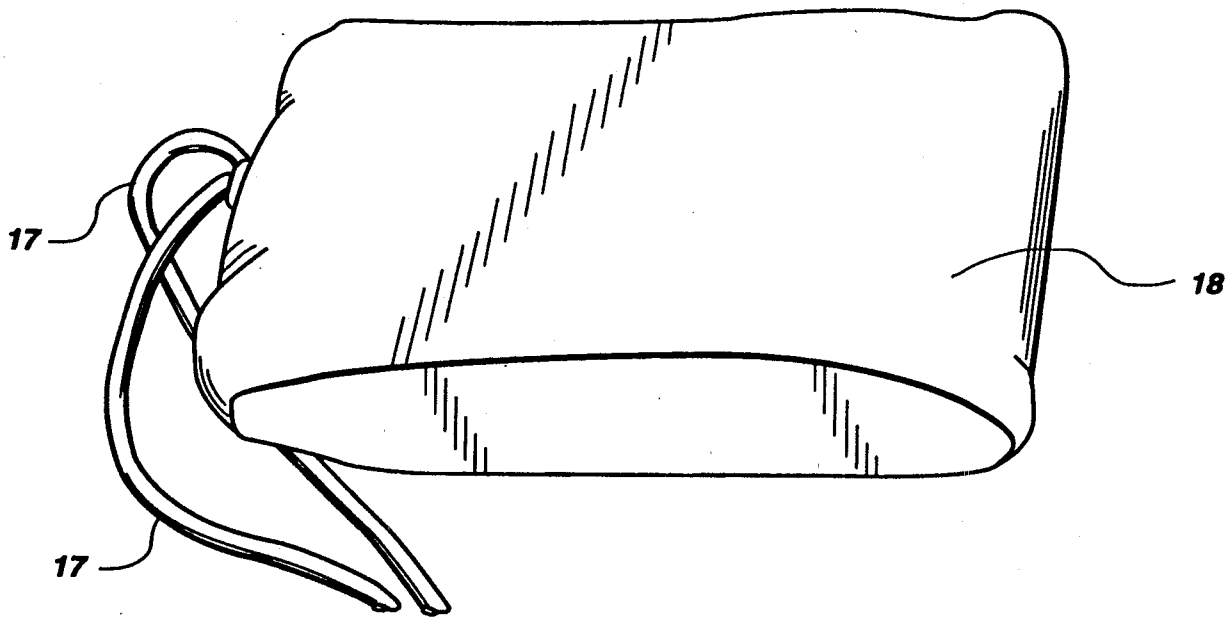
FIG. 2 is a side view of the pillow showing how the strap means end extend beyond the outside of the pillow.

The pillow used in the present invention is a small pillow having a durable material as a cover. The size and shape of the pillow may vary with the desired intention, i.e. may be a square, rectangle or circle. Preferably the pillow is substantially rectangular in shape, such as for example, 14 inches by 19 inches for the side and 15 inches by 20 inches for the length.

The preferred pillow selected for the present invention is one of 7½ oz. to 8½ oz. Lighter or heavier size may be used as desired.

The spreadable compressible and resilient material used inside the pillow may vary as desired. In most cases the pillow contains shreaded polystyrenes or polyurethanes. Preferred are the soluble fusible polymeric type as so illustrated.

The outside cover of the pillow may be of any durable material. The cover may be of any polymer or natural type material and is preferably a synthetic type of material. It may be possible to form a pillow from basic material such as cotton or polyester and then insert the pillow in a water-proof cover which is sewed at the end to completely enclose the pillow.

the strap means may be attached to the pillow by any suitable means such as by sewed in cord or strings or by use of grommets as shown in the drawings. It is preferred to sew the base of the cords or strings inside the pillow casing so as to have it firmly attached thereto. In case of grommets they may be pushed through the outside of the pillow cover in the appropriate places. In general, one utilized from 1 to 6 grommets some use of which is clearly shown in the drawings.

As noted, the strap means may be of any suitable type, but preferably are of cord type material or simple shoe lace strings. Other strap means can be prepared from thin nylon rope or strings.

The number of the strap means may vary as needed. When the cords are used it is preferred to have only one strap means sewed into the center of the cover. If grommets are used it is sometimes preferred to use double grommets pressed into the side of the pillow as shown in the drawings.

The location of the strap means may be any place as desired. With the cord straps, one preferably employs them at the end, while with the grommets, they are preferably located on the sides of the pillow as shown in the attached drawings.

As noted above, to utilize the pillow in the rolled up position, the pillow is laid out flat and then the pillow is then rolled from one side to the other and then the strap means surround the rolled up pillow and tied so as to maintain the pillow in the rolled up position. To utilize the pillow in the flap position, the strap means are then untied and the pillow roll out for use.

Figure 3:
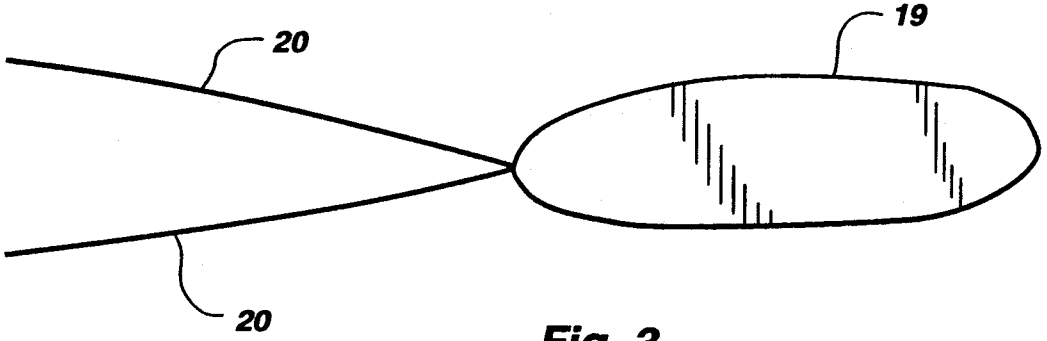
FIG. 3 is a top view of the pillow showing the out stretched cords which act as the handle means.
Figure 3A:
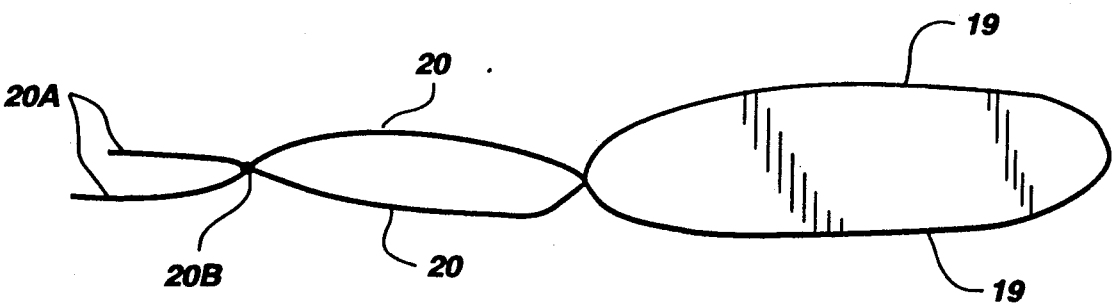
FIG. 3A shows how the ends of the cord can be tied together to form a handle to carry the pillow.
Figure 4:
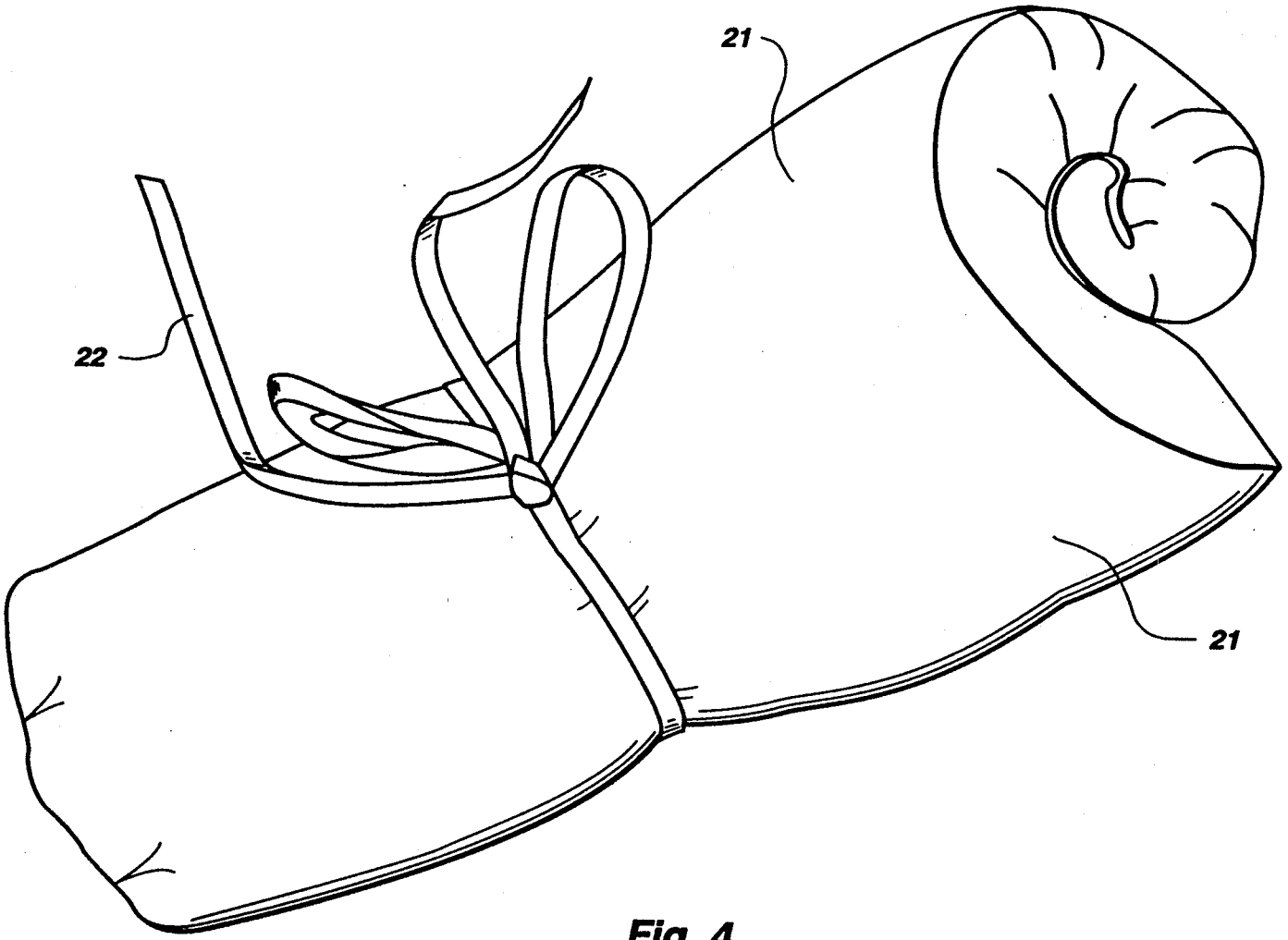
FIG. 4 illustrates how the pillow is rolled up and tied by the cord strap means.
Figure 5:
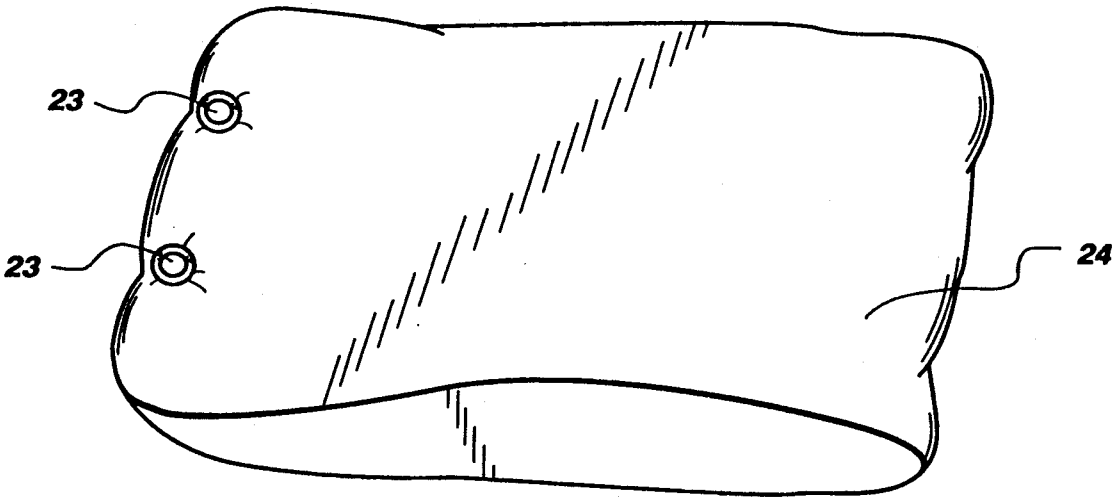
FIG. 5 is a side view of the pillow wherein two grommets are attached to the side of the pillow to hold the added strap means.
Figure 6:
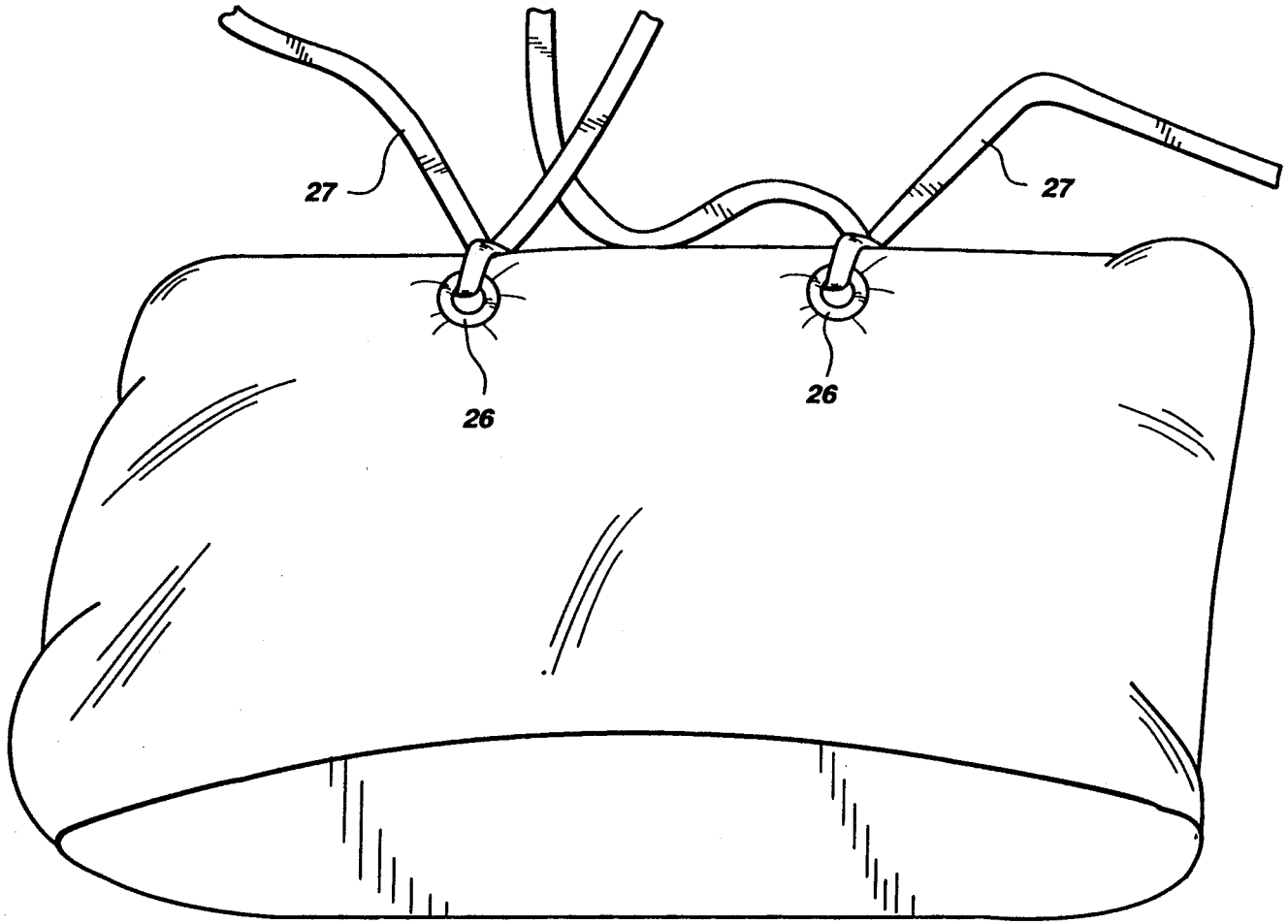
FIG. 6 illustrates how the strap means are inserted into the grommets and then tied together to hold the pillow in the rolled up position.
Figure 7:
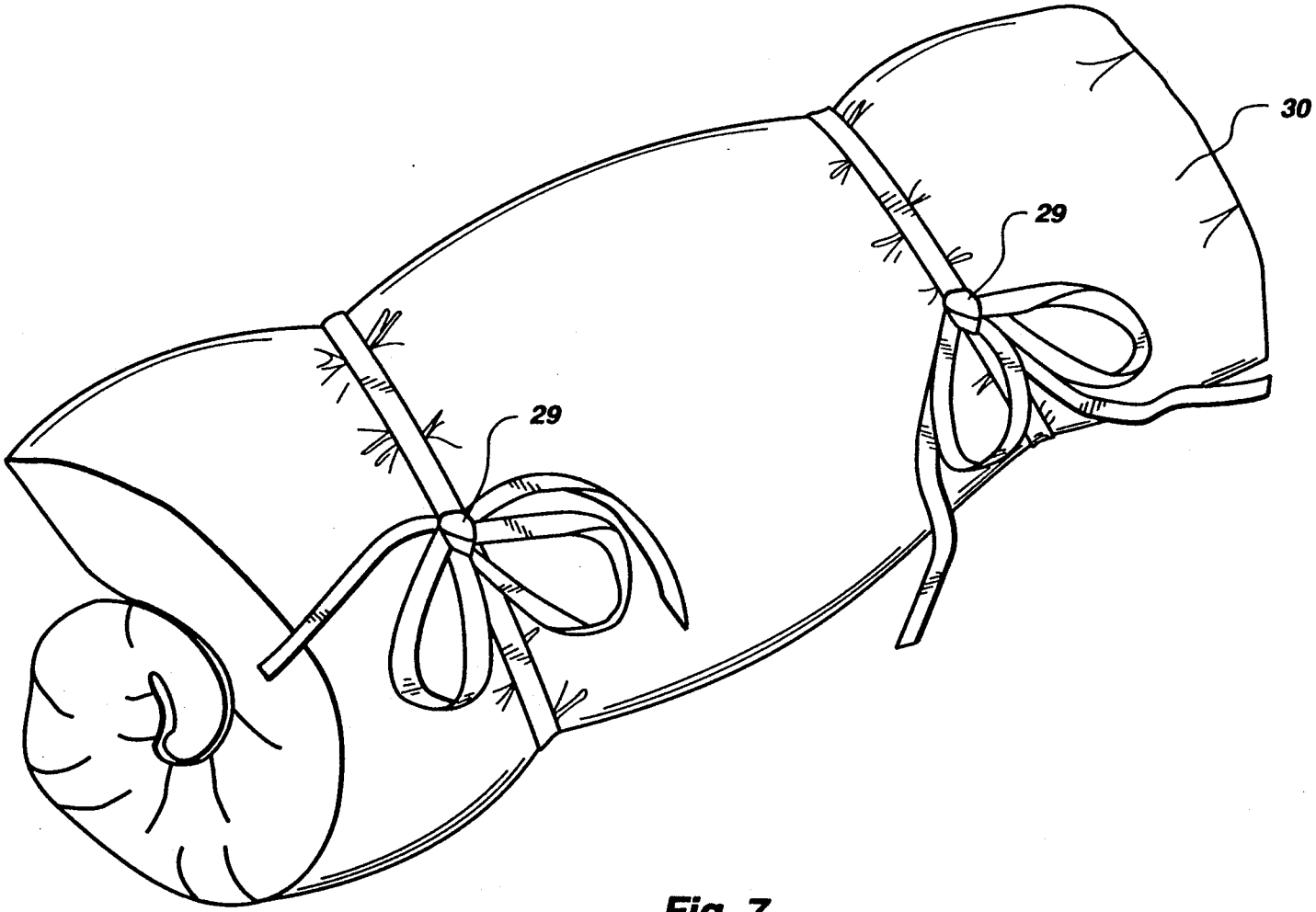
FIG. 7 illustrates how two cords can be inserted into the grommets and pulled around the rolled up pillow and hold it in that position.

It is sometimes desirable to use the strap means as a handle for carrying the pillow in the unrolled or rolled position. In this case, the ends of the strap means, such as the cord, are tied together and then used as the handle to carry the rolled or unrolled position. This modification is illustrated in FIG. 3A.

PREFERRED EMBODIMENT

To illustrate the present invention, the following example is given. It should be understood, however, that this example is given only as an illustration and should not be regarded as limiting the invention in any way.

A pillow having a dimension 14 inches by 19 inches was formed from a water resistant nylon taffeta and filled with shredded polyurethane particles having a size of about ½ inch. A fine ¼ inch nylon cord of about 28 inches was sewed in the middle at the end of the pillow casing so as to form two 14 inch strips outside the pillow. The pillow was then rolled up length wise nd tied with the two 14th inch strips. The pillow was then placed in a picnic basket where it utilized very little room. When the pillow was needed, the nylon cord ties were untied.

I claim as my Invention:

1. A small light-weight portable and rollable pillow (10) having an outside cover (11) and being generally rectangular in shape having four sides, two sides being about 14 to 19 inches and the other two sides being about 15 to 20 inches in length, said pillow being filled with spreadable and compressible resilient material (13) which is easily compressed and allows the pillow to be rolled up for travelling and when the pillow is unrolled it resumes its regular shape, said pillow having a strap (17) firmly attached near its approximate center to a solid attachment mans inside the pillow, located adjacent one of the sides of the pillow so as to form two free end s of the strap (20), said free ends being tied around the rolled up pillow to hold it in a rolled up positions and the remaining ends of the strap being tied together (20B) to form a handle for carrying the rolled up pillow.

2. The pillow as defined in claim 1 wherein the spreadable compressible resilient material inside the pillow is shredded polyurethane.

3. The pillow as in claim 1 wherein the strap means is a thin polyester cord.

4. A pillow as in claim 1 wherein the outside cover is water resistant.

5. A small light-weight portable and rollable pillow (1) with an outer covering (11), said pillow being of generally rectangular shape having four sides, two of the sides being about 14 inches to 19 inches and the other two sides being about 15 to 20 inches in length, said pillow having a smaller inside pillow having a covering (15) and filled with spreadable and compressible resilient material (10) which is easily compressed and allows the combined pillow to be rolled up for travelling, near its approximate center to a solid attachment means inside the pillow, located adjacent one of the sides of the larger pillow so as to form two free ends of the strap (20), said free ends being tied around the combined pillow when it is rolled up to form a rolled up pillow and the remaining ends of the strap being tied together to form a handle for carrying the rolled up pillow.

* * * * *